US005699395A

United States Patent [19]

Sylvester et al.

[11] Patent Number: 5,699,395

[45] Date of Patent: Dec. 16, 1997

[54] SEGMENTED STAYROD FOR RESTRICTING TRANSVERSE DISPLACEMENT OF A NUCLEAR HEAT EXCHANGER TUBE SUPPORT PLATE

[75] Inventors: Robert L. Sylvester; Robert M. Wilson; Jawahar K. Visaria, all of Pensacola, Fla.

[73] Assignee: Westinghouse Electric Corporation, Pittsburgh, Pa.

[21] Appl. No.: 539,804

[22] Filed: Oct. 5, 1995

[51] Int. Cl.[6] ..... G21C 15/00

[52] U.S. Cl. ..... 376/405; 165/162; 122/510

[58] Field of Search ..... 376/402, 405; 165/69, 162; 122/510, 511, 512

[56] References Cited

U.S. PATENT DOCUMENTS

| | | | |
|---|---|---|---|
| 4,079,701 | 3/1978 | Hickman et al. | 122/382 |
| 4,415,021 | 11/1983 | Bayless et al. | 165/162 |
| 4,576,068 | 3/1986 | Glatthorn | 82/1.4 |
| 4,653,576 | 3/1987 | Lagally | 165/162 |
| 4,676,201 | 6/1987 | Lahoda et al. | 376/316 |
| 4,704,994 | 11/1987 | Hu et al. | 122/379 |
| 4,777,911 | 10/1988 | Wepfer | 122/512 |
| 5,069,172 | 12/1991 | Shirey et al. | 122/382 |
| 5,329,565 | 7/1994 | Moore | 376/402 |

*Primary Examiner*—Daniel D. Wasil

[57] ABSTRACT

Segmented stayrod for restricting transverse displacement of a nuclear heat exchanger tube support plate. The stayrod includes a first rod segment interposed between the tubesheet and the first support plate, the first rod segment having an externally threaded riser extending through the hole formed in the first support plate. The stayrod also has a second rod segment interposed between the first support plate and the second support plate, the second rod segment having an internally threaded end portion for threadably engaging the threaded riser of the first rod segment. The second rod segment also has an externally threaded riser extending through the hole formed in the second support plate. An internally threaded fastener threadably engages the riser of the second rod segment for fastening the second rod segment to the second support plate. In this manner, the first support plate is captured between the first rod segment and the second rod segment. Moreover, the second support plate is captured between said second rod segment and the fastener, so that transverse displacement of the first support plate is restricted as the first support plate is captured between the first rod segment and the second rod segment and so that transverse displacement of the second support plate is restricted as the second support plate is captured between the second rod segment and the fastener.

6 Claims, 5 Drawing Sheets

SEGMENTED STAYROD FOR RESTRICTING TRANSVERSE DISPLACEMENT OF A NUCLEAR HEAT EXCHANGER TUBE SUPPORT PLATE

BACKGROUND OF THE INVENTION

This invention generally relates to stayrods and more particularly relates to a segmented stayrod for restricting transverse displacement of a nuclear heat exchanger tube support plate.

In a pressurized water nuclear reactor, the heat generated by a nuclear reaction in a reactor core is absorbed by a primary coolant that circulates through the reactor core and that is ultimately utilized to generate steam in a steam generator. The steam generator itself is an upright cylindrical pressure vessel with hemispherical end sections. A transverse tubesheet, located at the lower end of the cylindrical pressure vessel, divides the steam generator into a primary side, which is the lower hemispherical end section below the tubesheet, and a secondary side above the tubesheet. Below the tubesheet, a vertical wall (i.e., divider plate) bisects the primary side into an inlet section and an outlet section. The tubesheet has an array of thousands of holes into which are inserted the ends of U-shaped heat transfer tubes. One end of each U-shaped tube is inserted into a hole in the tubesheet, which hole communicates with the inlet section of the primary side, and the other end of the tube is inserted into another hole in the tubesheet, which hole communicates with the outlet section of the primary side. The steam generator also includes a plurality of spaced-apart transverse tube support plates having holes for passage of the tubes therethrough. The purpose of the support plates is to laterally support the tubes.

The heated primary coolant is introduced under pressure into the inlet section of the primary side, circulates through the U-shaped tubes and exits through the outlet section of the primary side. Water introduced into the secondary side of the steam generator circulates around the U-shaped tubes and is transformed into steam by heat given up by the primary coolant. The steam is transported to a turbine-generator by means of a main steam line or pipe interconnecting the steam generator and a turbine-generator for producing electricity.

However, during postulated accident conditions, such as a break in the main steam line, pressure differentials across the tube support plate may act to displace or deflect the support plate in such a manner as to compromise the ability of the support plate to laterally support the tubes where the tubes pass through the support plate. More specifically, once a steam line break event begins, it triggers a rapid depressurization in the steam generator, which leads to rapid water flashing. The rapid water flashing in turn results in blowdown of steam and water out of the steam generator thereby generating increased water velocity within the steam generator. This increased water velocity leads to a relatively large pressure drop across each tube support plate and thus increases the hydraulic loads across the tube support plate. Such increased hydraulic loading may be sufficient to cause the tube support plate to be transversely displaced or deflected.

Transverse displacement or deflection of the support plates during the transient is undesirable because such displacement may compromise the ability of the support plates to provide sufficient lateral support to the heat transfer tubes. Moreover, although highly unlikely, transverse displacement of the support plates may cause the support plates to wear against and breach the walls of the tubes extending through the holes of the support plates thereby allowing commingling of the radioactive primary fluid flowing through the tubes with the nonradioactive secondary fluid surrounding the tubes, a highly undesirable result.

In addition, if the tube has become cracked at the elevation of the support plate during normal operation of the steam generator, the crack may be sever enough to allow the tube to "burst" and sever due to the relatively high pressure of the primary fluid flowing through the tubes. Severing of the tube in this manner will produce opposing severed tube ends during normal operation and transverse displacement of the support plate during the transient may expose the severed tube ends. Such severed tube ends would be otherwise constrained by the surrounding support plate. However, during the transient, such severed tube ends become unconstrained due to transverse displacement of the tube support plate and may laterally move due to hydraulic forces. Lateral movement of the severed tube ends may be in an amount sufficient to damage adjacent heat transfer tubes. For all the foregoing reasons it is desirable to prevent transverse displacement of the tube support plates.

Although prior art segmented stayrods satisfactorily perform their intended function, these stayrods nonetheless have certain disadvantages associated with them. For example, some prior art segmented stayrod designs have an internally threaded female section at the top of a first rod comprising the segmented stayrod for threadably receiving an externally threaded male section belonging to a second rod with which the first rod is coaxially aligned. In such a prior art design, the internally threaded female section does not project beyond the top surface of the support plate. In addition, such prior art stayrods complicate assembly or fabrication of the steam generator because temporary stayrods must be used in order to align the support plates. Moreover, some prior art stayrod designs typically have a spacer pipe surrounding the stayrod. However, the stayrod-spacer pipe design displaces heat transfer tubes that could otherwise be disposed in the steam generator and blocks access to the spaces (i.e., tube lanes) between the heat transfer tubes. Displacing heat transfer tubes results in reduced steam production from the steam generator and blockage of the tube lanes interferes with sludge removal and inspection.

Nuclear heat exchanger stayrods not having spacer pipes for enhancing sludge removal are known. One such stayrod is disclosed in U.S. Pat. No. 5,329,565 titled "Stayrod Arrangement" issued Jul. 12, 1994 in the name of Jay T. Moore. This patent discloses a stayrod arrangement for enhancing removal of sludge from nuclear heat exchangers as it simultaneously ties the support plates together. The heat exchanger has a plurality of heat exchange tubes which define a tube lane therebetween and the tube lane may have sludge deposits therein. The stayrod arrangement includes a rod having planer side portions oriented parallel to the direction of a fluid stream introduced into the steam generator to flush the sludge deposits from the tube lane. The planer side portions of the stayrod present a reduced cross-sectional profile to the fluid stream for preventing blockage of the space between the heat transfer tubes, so that sludge deposits may be removed by the fluid stream issuing from a sludge lance that is introduced into the heat exchanger. Although the stayrod disclosed in the Moore patent does not include a spacer pipe, this stayrod does include an anti-rotation connector at an end portion thereof. The anti-rotation connector is located above the sludge deposits so as not to interfere with the fluid stream. However, the anti-rotation connector has a transverse profile significantly larger than the heat transfer tube diameter, thereby necessarily reducing the number of heat transfer tubes that may be disposed in the steam generator. That is, the anti-rotation connector occupies space that would otherwise be occupied by heat transfer tubes. Moreover, assembly of the steam generator is complicated by the need to weld the anti-rotation connector to the support plate. In addition, this prior art stayrod design has an internally threaded female section at the top of a first rod comprising the segmented stayrod for threadably receiving an externally threaded male section belonging to a second rod with which the first rod is coaxially aligned. This feature of the Moore stayrod complicates assembly or fabrication of the steam generator because temporary stayrods must be used in order to align the support plates.

Thus, although the above-recited prior art discloses stayrods for tying together heat transfer tube support plates in a nuclear steam generator, use of such prior art stayrods complicates assembly of the steam generator and necessarily reduce the number of heat transfer tubes that may be disposed in the steam generator.

Therefore, what is needed is a segmented stayrod for suitably restricting transverse displacement of a nuclear heat exchanger tube support plate.

SUMMARY

Disclosed herein is a segmented stayrod for restricting transverse displacement of a nuclear heat exchanger tube support plate having a plurality of holes therethrough. The stayrod includes a first rod segment interposed between the tubesheet and the first support plate, the first rod segment having an externally threaded riser extending through the hole formed in the first support plate. The stayrod also has a second rod segment interposed between the first support plate and the second support plate, the second rod segment having an internally threaded end portion for threadably engaging the threaded riser of the first rod segment. The diameters of the first and second rod segments are generally equal to the diameter of the heat transfer tube so that no tube lanes are blocked in order to enhance sludge removal from the support plates and to enhance inspection of the support plate. The second rod segment also has an externally threaded riser extending through the hole formed in the second support plate. An internally threaded fastener threadably engages the riser of the second rod segment for fastening the second rod segment to the second support plate. In this manner, the first support plate is captured between the first rod segment and the second rod segment. Moreover, the second support plate is captured between the second rod segment and the fastener. Thus, transverse displacement of the first support plate is restricted as the first support plate is captured between the first rod segment and the second rod segment. In addition, transverse displacement of the second support plate is restricted as the second support plate is captured between the second rod segment and the fastener. The segmented stayrod of the present invention may have any number of rod segments depending on the number of support plates.

An object of the present invention is to provide a segmented stayrod that prevents transverse displacement of the support plate in order to preclude wear of the support plate against the heat transfer tubes during a steam generator transient.

Another object of the present is to provide a segmented stayrod that prevents transverse displacement of the support plate in order to prevent any severed tubes ends from laterally moving to damage adjacent heat transfer tubes during a steam generator transient.

Yet another object of the present invention is to provide a segmented stayrod that does not reduce the number heat transfer tubes that may be disposed in the steam generator.

A further object of the present invention is to provide a segmented stayrod that enhances sludge removal from tube lanes.

A feature of the present invention is the provision of a stayrod comprising a plurality of rod segments interposed between respective ones of a plurality of support plates for axially supporting the support plates such that transverse displacement of the support plates is restricted.

Another feature of the present invention is the provision of a stayrod comprising rod segments wherein the cross sectional area of each rod segment is generally less than or equal to the diameter of any of the heat transfer tubes to prevent tube lane blockage for enhancing sludge removal.

An advantage of the present invention is that structural integrity of the heat transfer tubes is not compromised during a steam generator transient.

Another advantage of the present invention is that sludge removal is enhanced.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENT

Figure 1:
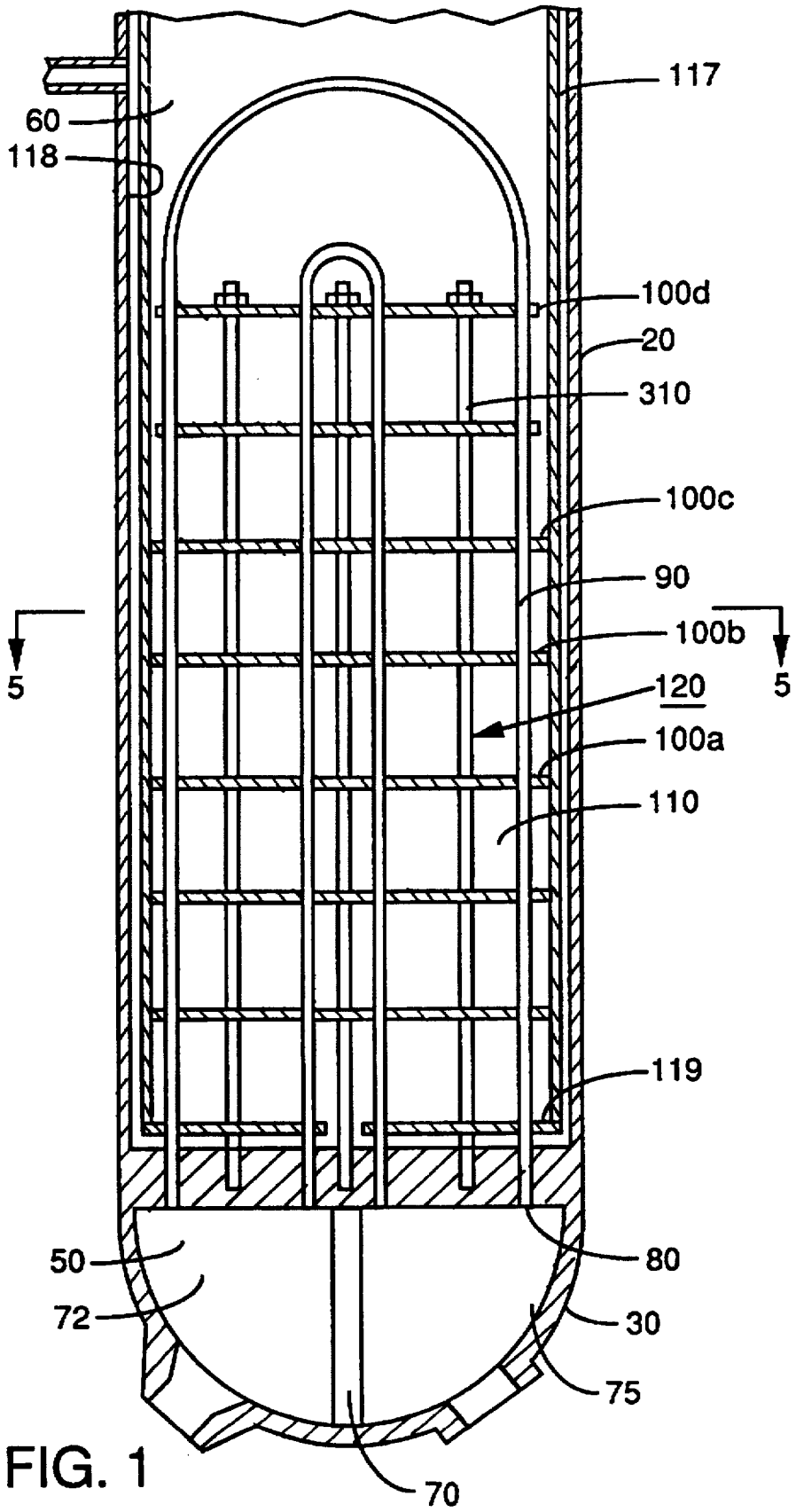
FIG. 1 is a view in partial vertical section of a typical nuclear steam generator with parts removed for clarity, the steam generator having a plurality of heat transfer tube support plates disposed therein tied together by a plurality of interconnected segmented stayrods for restricting transverse displacement of the support plates.

Referring to FIG. 1, there is shown a typical nuclear heat exchanger or steam generator, generally referred to as 10, for generating steam. Steam generator 10 comprises a cylindrical body portion 20 enclosed at its lower end by a hemispherical shell 30. A transverse plate or tubesheet 40 divides steam generator 10 into a primary side 50 below tubesheet 40 and a secondary side 60 above tubesheet 40. The primary side 50 is divided by a divider plate 70 into an inlet section 72 and an outlet section 75.

Figure 2:
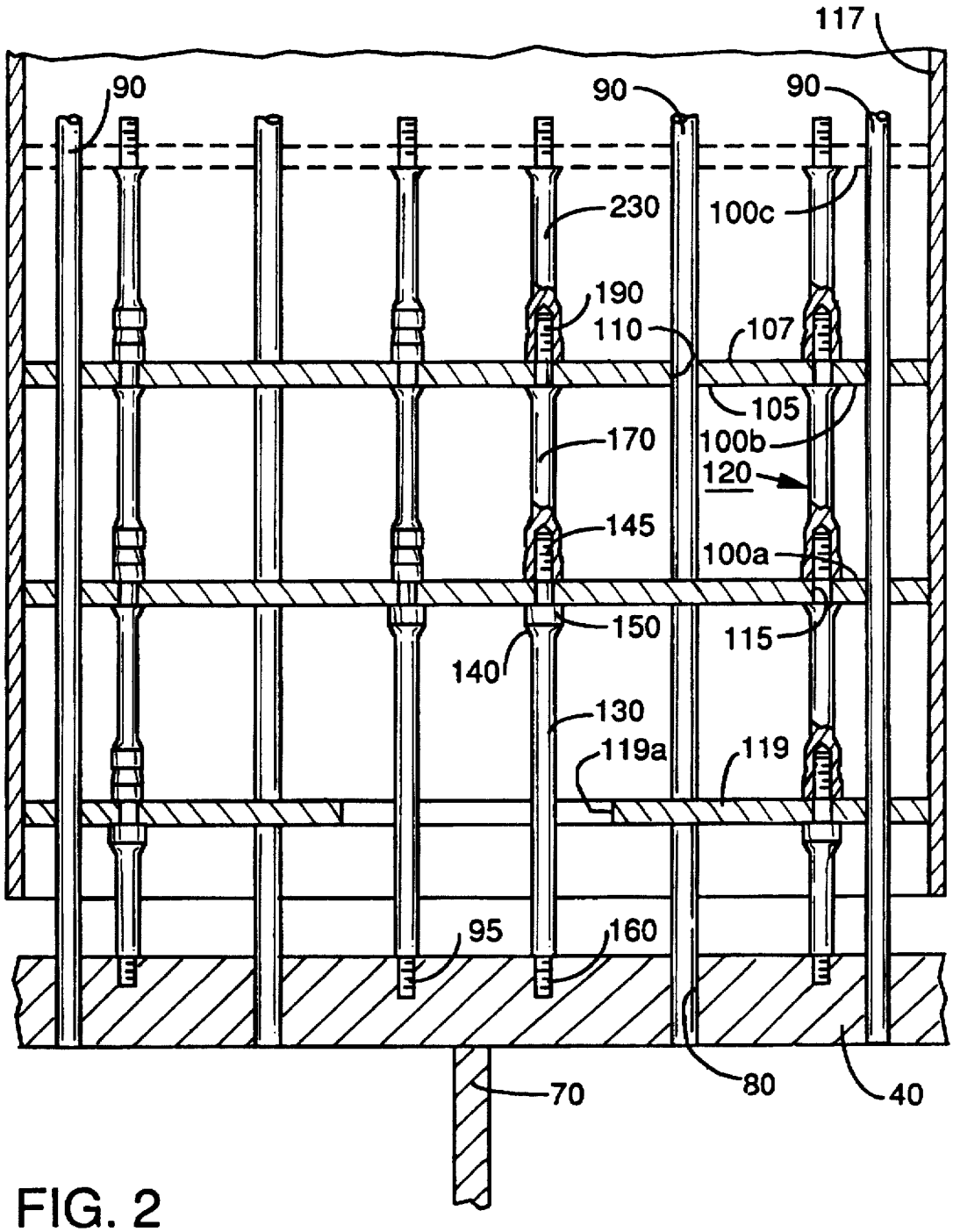
FIG. 2 is a view in partial vertical section of the plurality of segmented stayrods connected to respective ones of the plurality of heat transfer tube support plates.

Referring to FIGS. 1 and 2, tubesheet 40 has a plurality of holes 80 therethrough. A plurality of U-shaped heat transfer tubes 90 of predetermined diameter (only two of which are shown) have ends received in respective ones of the holes 80 so that one end of each tube 90 communicates with inlet section 72 and the other end of each tube 90 communicates with outlet section 75. The spacing or pitch between tubes 90 defines a plurality of tube lanes 93 therebetween (see FIG. 4). As shown in FIGS. 1 and 2, tubesheet 40 also has a plurality of threaded blind bores 95 for reasons disclosed hereinbelow. Each tube 90 is laterally supported on secondary side 60 by a plurality of spaced-apart parallel transverse plate members, such as support plates 100*a*, 100*b*, 100*c* and 100*d*, which are designated herein as a first, second, third and top-most support plate, respectively. Of course, steam generator 10 may have any number of support plates disposed therein.

Still referring to FIGS. 1 and 2, each support plate 100*/a/b/c/d* has an underside or first side 105 and a top or second side 107 opposite and parallel to first side 105. In addition, each support plate 100*a/b/c/d* has a plurality of openings 110 formed therethrough for passage of each tube 90, each opening 110 being of a predetermined diameter. Each support plate also has a plurality of holes 115 for reasons disclosed hereinbelow, each hole 115 having a diameter equal to the diameter of opening 110. Steam generator 10 also includes a cylindrical wrapper 117 that encircles the plurality of tubes 90 to define an annular downcomer passage 118 between body portion 20 and wrapper 117. Steam generator 10 may further include a baffle plate 119 positioned above tubesheet 40 and which is provided with central cutout 119*a*. The primary purpose of baffle plate 119 and its associated cutout 119*a* is to reduce the vertical flow velocity of the secondary fluid across the surface of tubesheet 40 in order to increase the flow velocity of the secondary fluid radially inwardly along tubesheet 40, so that sludge build-up on tubesheet 40 is reduced. A secondary purpose of baffle plate 119 is to laterally support tubes 90. Steam generated by steam generator 10 is transported to a turbine-generator (not shown) by means of a pipe or main steam line (not shown) interconnecting steam generator 10 and the turbine-generator. However, main steam line may develop an inadvertent break therein causing a depressurization transient in steam generator 10 that could lead to transverse displacement or deflection of support plates 100*a/b/c/d*.

Figure 3:
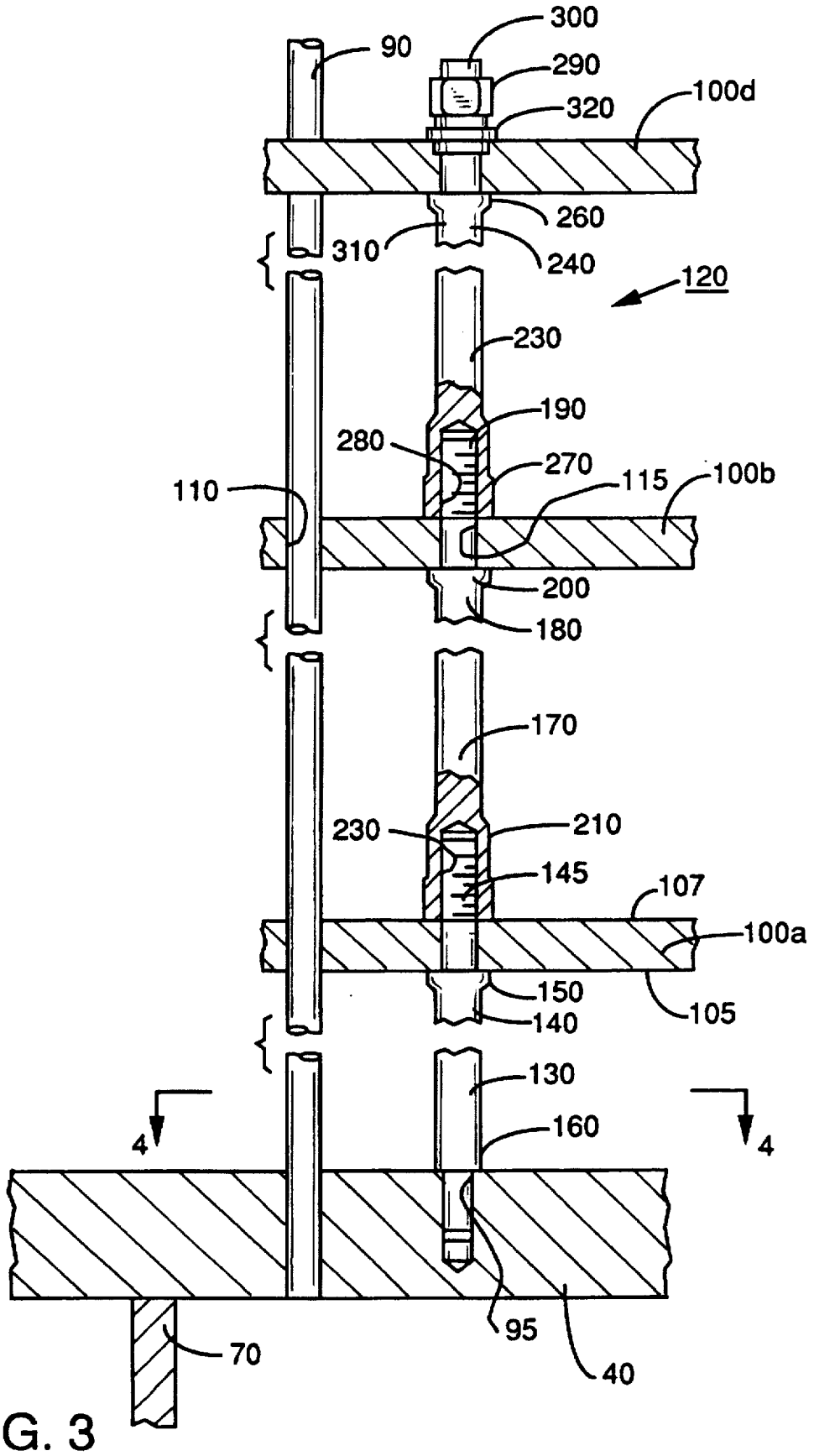
FIG. 3 is a view in partial vertical section of one of the segmented stayrods.
Figure 4:
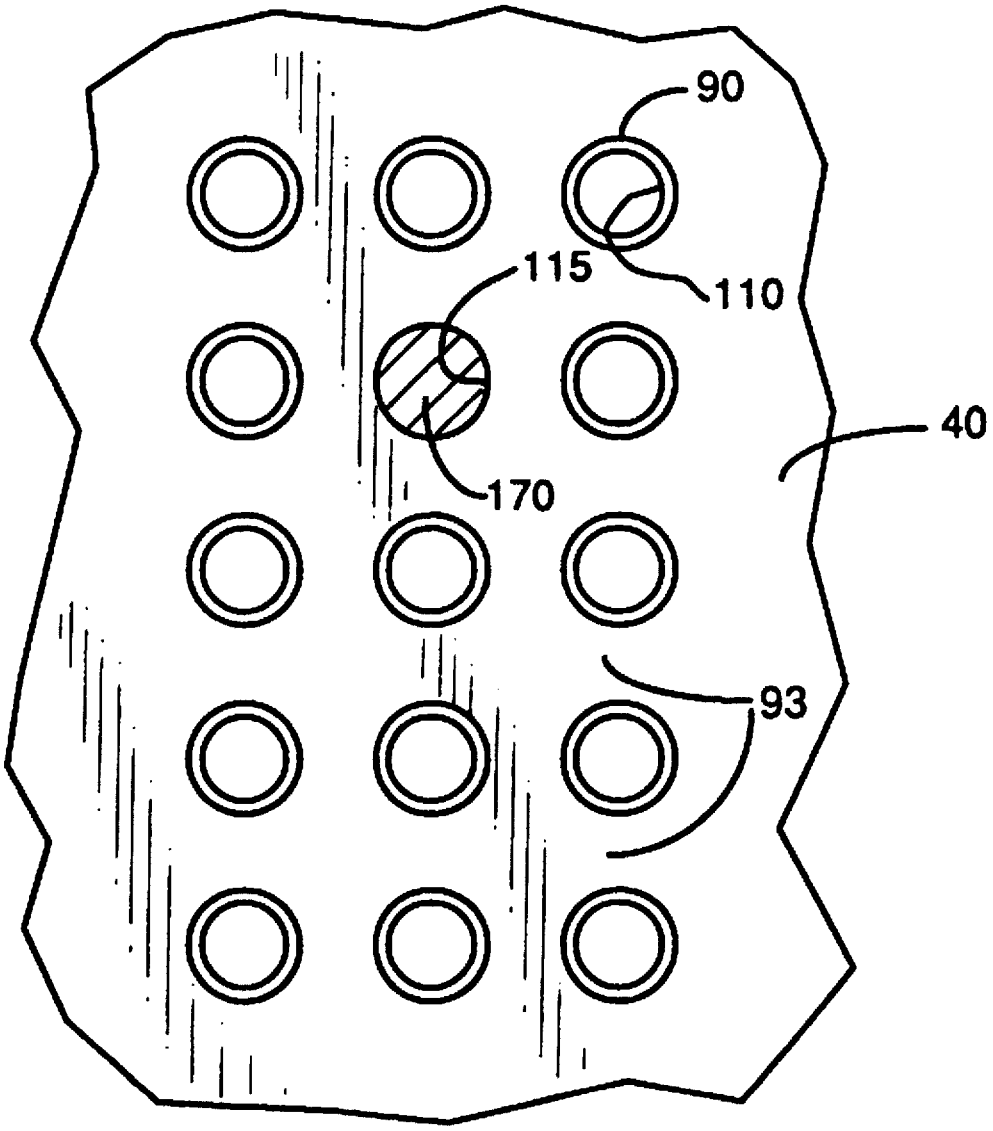
FIG. 4 is a view taken along section line 4—4 of FIG. 3.

Referring to FIGS. 2, 3, and 4, there is shown a segmented stayrod, generally referred to as 120, for restricting transverse displacement or deflection of support plates 100*a/b/c/d* during the depressurization transient (e.g., main steam line break event). Segmented stayrod 120 comprises first anti-deflection or support means, such as an elongate generally cylindrical first rod segment 130, for supporting first support plate 100*a*. First rod segment 130 has a distal end portion 140 that includes a generally cylindrical first riser 145 extending through hole 115 formed through first support plate 100*a*. First riser 145 extends beyond top side 107 of first support plate 100*a* for reasons disclosed hereinbelow. As described in more detail presently, first rod segment 130 is adapted or configured to engage first support plate 100*a* for supporting first support plate 100*a*. In this regard, distal end portion 140 includes an annular first flange or first shoulder 150 for abutting against underside 105 of first support plate 100*a*. Although the diameter of first rod segment 130 is limited to be generally less than or equal to the diameter of tube 90, first shoulder 150 itself has a diameter greater than the diameter of tube 90. However, this increased localized diameter of first shoulder 150 nonetheless allows sufficient access to tube lane 93 for purposes of sludge removal by means of sludge lancing, which is a technique well known in the art. First rod segment 130 also has an externally threaded proximal end portion 160 for threadably engaging threaded bore 95 formed in tubesheet 40. The terminology "proximal end portion" is defined herein to mean that end portion nearer divider plate 70 and the terminology "distal end portion" is defined herein to mean that end portion farther away from divider plate 70.

Still referring to FIGS. 2, 3, and 4, segmented stayrod 120 further comprises second anti-deflection or support means, such as an elongate generally cylindrical second rod segment 170, for supporting second support plate 100*b*. Second rod segment 170 has a distal end portion 180 that includes a generally cylindrical second riser 190 extending through hole 115 formed through second support plate 100*b*. Second riser 190 extends beyond top side 107 of second support plate 100*b* for reasons disclosed hereinbelow. As described in more detail presently, second rod segment 170 is adapted or configured to engage second support plate 100*b* for supporting second support plate 100*b*. In this regard, distal end portion 180 includes an annular second flange or second shoulder 200 for abutting against underside 105 of second support plate 100*a*. Although the diameter of second rod segment 170 is limited to be generally less than or equal to the diameter of tube 90, second shoulder 200 itself has a diameter greater than the diameter of tube 90. However, this increased localized diameter of second shoulder 200 nonetheless allows sufficient access to tube lane 93 for purposes of sludge removal by means of sludge lancing. Second rod segment 170 has a proximal end portion 210 which includes a threaded bore 220 therein for threadably receiving threaded first riser 190. Moreover, proximal end portion 210 has a diameter sufficient to abut against top side 107 of support plate 100*a* when second rod segment 170 is coaxially aligned with first rod segment 130. Alignment of second rod segment 170 with first rod segment allows first riser 190 to be fully threaded into bore 220. In this manner, first support plate 100*a* is captured between first rod segment 130 and second rod segment 170 as first rod segment 130 is threadably connected to second rod segment 170.

Referring yet again to FIGS. 2, 3, and 4, segmented stayrod 120 may further comprise third anti-deflection or support means, such as an elongate generally cylindrical third rod segment 230, for supporting third support plate 100*c*. Third rod segment 230 has a distal end portion 240 that includes a generally cylindrical third riser 250 extending through hole 115 formed through third support plate 100*c*. Third riser 250 extends beyond top side 107 of third support plate 100*c* for reasons disclosed hereinbelow. As described in more detail presently, third rod segment 170 is adapted or configured to engage third support plate 100*c* for supporting third support plate 100*c*. In this regard, distal end portion 240 includes an annular third flange or third shoulder 260 for abutting against underside 105 of third support plate 100*c*. Although the diameter of third rod segment 230 is limited to be generally less than or equal to the diameter of tube 90, third shoulder 260 itself has a diameter greater than the diameter of tube 90. However, this increased localized diameter of third shoulder 260 nonetheless allows sufficient access to tube lane 93 for purposes of sludge removal. Third rod segment 230 has a proximal end portion 270 which includes a threaded bore 280 therein for threadably receiving threaded second riser 190. Moreover, proximal end portion 270 abuts against top side 107 of second support plate 100*b* when third rod segment 230 is coaxially aligned with second rod segment 170 and when second riser 190 is fully threaded into bore 280. In this manner, second support plate 100*b* is captured between second rod segment 170 and third rod segment 230 as second rod segment 170 is threadably connected to third rod segment 230.

As best seen in FIG. 3, after the desired number of support plates 100*a/b/c* are connected by rod segments 130/170/230 of stayrod 120, fastener means, such as an internally threaded nut or fastener 290 is caused to threadably engage a top-most riser 300 associated with a highest or upper-most rod segment, such as rod segment 310. As fastener 290 is fully threadably run-down riser 310 which projects beyond hole 115, it will engage support plate 100*d* for fastening highest or upper-most rod segment 310 to support plate 100*d*. If desired, fastener 290 may include a washer 320 interposed between fastener 290 and the top side 107 of support plate 100*d*.

Figure 5:
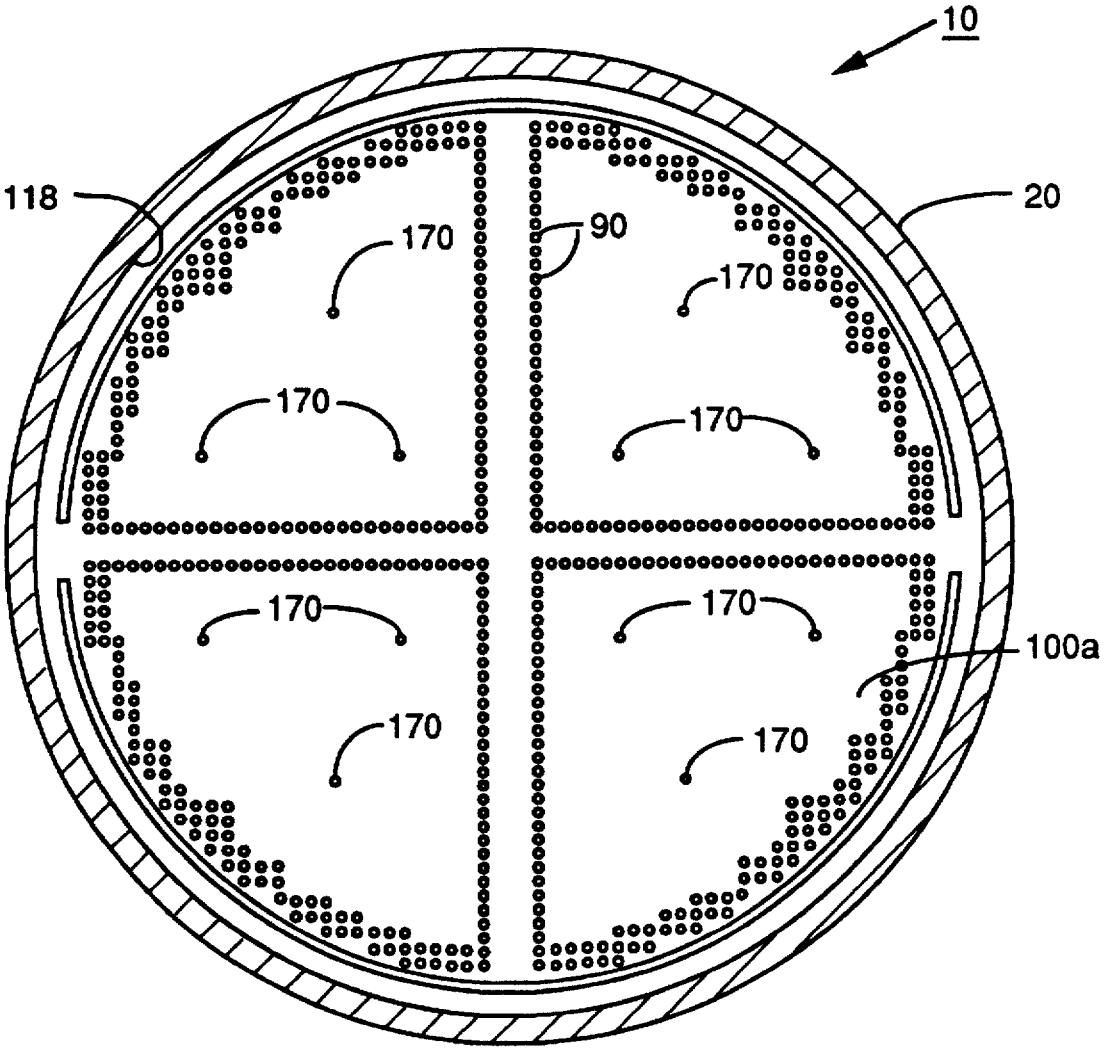
FIG. 5 is a view taken along section line 5—5 of FIG. 1.

Turning now to FIG. 5, the placement of stayrods 120 is shown relative to tubes 90. Preferably stayrods 120 are located in-line with the pattern of tube holes 110 formed in support plates 100*a/b/c/d*. Thus, no stayrods 120 are located in the tube lanes 93. In the preferred embodiment of the invention, stayrods 120 are positioned in an outer ring of eight stayrods and an inner ring of four stayrods to provide the desired support to support plates 100*a/b/c/d*. The inner ring of stayrods 120 preferably passes through cutout 119*a*.

As disclosed hereinabove, stayrods 130 each has an externally threaded riser 145 and an externally threaded proximal end portion 160. By way of example only and not by way of limitation, proximal end portion 160 is approximately ⅝ inch in diameter to provide a shoulder for seating the proximal end portion 160 of rod segment 130 against tubesheet 40 while maintaining a stayrod diameter approximately equal to the heat transfer tube diameter of ⅞ inch. Threaded riser 145 is approximately ¾ inch in diameter and shoulder 150 is approximately 1 and ¼ inch in diameter. Although the diameter of shoulder 150 is slightly larger than the diameter of tube 90, the diameter of shoulder 150 nonetheless allows sufficient access to tube lanes 93 for purposes of sludge removal and inspection. Threaded bore 220, which is formed in rod segment 170, has a diameter of approximately ¾ inch to threadably mate with externally threaded riser 145. In order to enhance corrosion resistance, stayrods 130/170/230 are preferably made from SA 739 B22 material comprising approximately 2.25% chromium and 1.00% molybdenum.

It will be understood from the description hereinabove, that segmented stayrod 120 ties together support plates 100*a/b/c/d* and baffle plate 119 to maintain these plate members in their predetermined spaced-apart relationship by restricting transverse displacement or deflection of support plates 100*a/b/c/d* and baffle plate 119.

It will be appreciated from the description hereinabove that an advantage of the present invention is that it prevents displacement or deflection of the support plates in order to preclude wear of the support plates against the heat transfer tubes during a steam generator transient.

It will be appreciated that another advantage of the present invention is that it prevents displacement or deflection of the support plates in order to prevent severed tubes ends from laterally moving to damage adjacent heat transfer tubes during a steam generator transient.

It will be appreciated that yet another advantage of the present invention is that use thereof does not reduce the number of heat transfer tubes that may be disposed in the steam generator when compared to prior art stayrods.

It will be appreciated that a further advantage of the present invention is that use thereof enhances sludge removal from tube lanes because the tube lanes are not substantially blocked.

It will be appreciated that still another advantage of the present invention is that assembly of tube support plates during construction of the steam generator is made easier because the riser portion of each rod segment projects or extends through its respective hole in the baffle plate and support plate as opposed to prior art designs where the stayrod does not project through the hole in the support plate. That is, the riser portion of each segment projects beyond its respective baffle or support plate to aid in plate alignment and assembly.

Although the invention is illustrated and described herein in its preferred embodiments, it is not intended that the invention as illustrated and described be limited to the details shown, because various modifications may be obtained with respect to the invention without departing from the spirit of the invention or the scope of equivalents thereof. For example, although the invention is described for use in a nuclear steam generator, it is suitable for use with any structure where it is desirable to restrict transverse displacement or deflection of a plate member associated with the structure.

Therefore, what is provided is a segmented stayrod for restricting transverse displacement of a nuclear heat exchanger tube support plate.

What is claimed is:

1. In a nuclear heat exchanger having therein a first plate member disposed parallel to a second plate member, each of the first and second plate members having a hole formed therethrough, a segmented stayrod for restricting transverse displacement of at least one of the first and second plate members, comprising:

(a) a first support means for supporting the first plate member, said first support means having an end portion extending through the hole formed through the first plate member, said first support means configured to engage the first plate member;

(b) a second support means connected to the end portion of the said first support means and interposed between the first plate member and the second plate member for supporting the second plate member, said second support means having an end portion extending through the hole formed through the second plate member, said second support means configured to engage the first plate member as said second support means is connected to the end portion of said first support means; and (c) a fastener means engaging the end portion of said second support means and capable of engaging the second plate member for fastening said second support means to the second plate member, whereby transverse displacement of at least one of the first and second plate members is restricted as said first support means is connected to said second support means and as said fastener means fastens said second support means to the second plate member.

2. The segmented stayrod of claim 1, wherein said first support means has an end portion thereof anchored in a tubesheet disposed in the heat exchanger.

3. In a nuclear steam generator pressure vessel having therein a tubesheet having a threaded bore and a heat transfer tube of predetermined diameter extending through the tubesheet, the tubesheet disposed parallel to a first tube support plate disposed parallel to a second tube support plate, the first tube support plate and second tube support plate each having a hole formed therethrough, a segmented stayrod for restricting transverse displacement of the first tube support plate and the second tube support plate, comprising:

(a) an elongate first rod segment interposed between the tubesheet and the first tube support plate, said first rod segment having an externally threaded proximal end portion threadably engaging the threaded bore of the tubesheet for anchoring said first rod segment in the tubesheet, said first rod segment having a distal end portion having an externally threaded riser extending through the hole formed in the first tube support plate, the distal end portion of said first rod segment having an annular shoulder therearound for intimately engaging the first tube support plate;

(b) elongate second rod segments interposed between the first tube support plate and the second tube support plate, including a first said second rod segment having an internally threaded proximal end portion for threadably engaging the distal end portion of said first rod segment and a second said second rod segment having a distal end portion having an externally threaded riser extending through the hole formed in the second tube support plate, the proximal end portion of the first said second rod segment intimately engaging the first tube support plate, the distal end portion of the second said second rod segment having an annular shoulder therearound for intimately engaging the second tube support plate, and (c) an internally threaded fastener threadably engaging the riser of the second said second rod segment and capable of engaging the second tube support plate for fastening the second said second rod segment to the second tube support plate, whereby said first tube support plate is captured between said first rod segment and the first said second rod segment as the annular shoulder of said first rod segment engages the first tube support plate and as the proximal end portion of the first said second rod segment engages the first tube support plate, whereby said second tube support plate is captured between the second said second rod segment and said fastener as said fastener engages the second tube support plate, whereby transverse displacement of the first tube support plate is restricted as the first tube support plate is captured between said first rod segment and the first said second rod segment and whereby transverse displacement of the second tube support plate is restricted as the second tube support plate is captured between the second said second rod segment and said fastener.

4. The segmented stayrod of claim 3, wherein the cross sectional area of said first rod segment is less than or equal to the diameter of the heat transfer tube for enhancing sludge removal from the tubesheet.

5. In a heat exchanger having a plate member disposed therein, a stayrod, comprising means including a riser extending upwardly of a shoulder and through the plate member, the shoulder engaged with the plate member, coupled to the plate member for restricting vertical movement of the plate member.

6. The stayrod of claim 5, wherein said means for restricting vertical movement comprises a plurality of segments.

* * * * *